US007464571B2

(12) United States Patent
Uchida

(10) Patent No.: US 7,464,571 B2
(45) Date of Patent: Dec. 16, 2008

(54) HYDROFORMING METHOD AND MOLD USED FOR THE HYDROFORMING METHOD

(75) Inventor: Mitsutoshi Uchida, Amagasaki (JP)

(73) Assignees: Sumito Metal Industries, Ltd., Osaka (JP); NSK Ltd., Tokyo (JP); NSK Steering Systems Co., Ltd., Tokyo (JP); Sumitomo Pipe & Tube Co., Ltd., Ibaraki (JP)

( * ) Notice: Subject to any disclaimer, the term of this patent is extended or adjusted under 35 U.S.C. 154(b) by 0 days.

(21) Appl. No.: 11/507,669

(22) Filed: Aug. 18, 2006

(65) Prior Publication Data

US 2006/0277958 A1 Dec. 14, 2006

Related U.S. Application Data

(63) Continuation of application No. PCT/JP2005/002567, filed on Feb. 18, 2005.

(30) Foreign Application Priority Data

Feb. 20, 2004 (JP) ..... 2004-044358

(51) Int. Cl.
*B21D 9/15* (2006.01)
*B21D 28/28* (2006.01)

(52) U.S. Cl. ..... 72/55; 72/58; 72/370.26; 83/53; 29/421.1

(58) Field of Classification Search ..... 72/55, 72/56, 58, 61, 62, 370.26; 29/421.1; 83/53
See application file for complete search history.

(56) References Cited

U.S. PATENT DOCUMENTS

| | | | | |
|---|---|---|---|---|
| 5,816,089 | A * | 10/1998 | Marando | 72/55 |
| 6,591,648 | B1 * | 7/2003 | Ash et al. | 72/55 |
| 7,104,099 | B1 * | 9/2006 | Ghiran et al. | 29/421.1 |
| 7,111,482 | B1 * | 9/2006 | Ghiran | 72/55 |
| 7,249,480 | B2 * | 7/2007 | Ghiran et al. | 72/370.27 |

FOREIGN PATENT DOCUMENTS

| | | |
|---|---|---|
| JP | 06-292929 | 10/1994 |
| JP | 11-077183 | 3/1999 |
| JP | 2000-351029 | 12/2000 |
| JP | 2001-018016 | 1/2001 |
| JP | 2001-259757 | 9/2001 |

* cited by examiner

*Primary Examiner*—David B Jones
(74) *Attorney, Agent, or Firm*—Clark & Brody

(57) ABSTRACT

According to the hydroforming method by the invention, when slots with the aspect ratio of 3 or more are pierced onto the bulge-formed portion made by the hydroforming, even the piercing can be carried out within a series of processing steps in the hydroforming, thereby eliminating the piercing operation by means of the cumbersome machining process such as milling and ensuring an excellent slot configuration. Thus, the hydroformed parts by the invention are best suited for the automobile parts etc. where various piercing operations are required, and the mold used for the hydroforming method by the invention can be widely employed for processing the automobile parts etc., whereby the invention can be applied for processing the parts in automobiles and industrial machineries as well.

5 Claims, 7 Drawing Sheets

HYDROFORMING METHOD AND MOLD USED FOR THE HYDROFORMING METHOD

CROSS REFERENCE TO RELATED APPLICATION

This application is a continuation of International Patent Application No. PCT/JP2005/002567 filed Feb. 18, 2005. This PCT application was not in English as published under PCT Article 21(2).

TECHNICAL FIELD

The present invention relates to a hydroformed part, a hydroforming method and a mold for use in the hydroforming method in which a pressure is applied to a working fluid supplied into the inside of a cylindrical metal blank to bulge-form said blank, and more particularly, to a hydroformed part, a hydroforming method and a mold for use in the hydroforming method in which along with a bulge-forming step among a series of processing steps in a hydroforming process, a slot is pierced onto the bulge-formed portion. Therefore, the hydroforming process pertinent to the present invention is not limited to the bulge-forming step that renders the workpiece bulge-formed, but encompass the piercing step that the slot is pierced.

BACKGROUND ART

Usually, in the hydroforming process, the working fluid is introduced inside the metal tube as of the starting material (hereinafter, referred to as "metal tube blank(s)") and the pressure is applied (hereinafter, referred to as "internal pressure") to bulge-form said blank in the manner of following the contour of a mold that holds said blank, whereby the tubular part with a complex shape can be fabricated. Thus, the hydroforming process is widely applied for processing automobile parts.

These automobile parts generally require various piercing operations such as the one for the holes for use in fixing other parts or the other for the holes for use in a locator, so that after forming into a predetermined shape, the piercing operation is occasionally required. In this occasion, when the piercing operation becomes necessary for the press stamped parts of steel sheets, the dies and punch can be employed as a tool and holes are made at the predetermined positions where appropriate.

For all this, as the part formed by the hydroforming process entails the tubular shape, it is difficult to arrange dies at the predetermined positions inside the tube, except proximity to tube ends. Therefore, it is not possible to readily conduct a piercing operation using the punch and dies in the similar way to the piercing for the press stamped parts of steel sheets.

Accordingly, there has been proposed various methods utilizing the internal pressure to perform a piercing operation onto the hydroformed parts so far. For instance, in Japanese Patent Application Publication No. 6-292929 (sections [0036] and [0037], FIGS. 21 and 22), there is proposed a method for punching the holes wherein for the tubular frame member, holes are made by punching shortly after completing the formation of the bulge-formed portion by the hydroforming, in the state that high internal pressure is kept (hereinafter, referred to as "a first prior art").

And in the Japanese Patent Application Publication No. 2001-18016, there is disclosed a piercing method that: the die port is disposed onto the mold; a punch is inserted so as for its top face to become flush with the inside contour surface of the mold cavity to bulge-form the metal tube blank; the punch is retreated while the internal pressure is maintained; the internal pressure is applied towards the bulge-formed portion formed at the bottom of the die port; and then, a piercing operation is performed (hereinafter, referred to as "a second prior art").

According to the proposed "a first and second prior arts", since after bulge-forming by the hydroforming, the internal pressure is applied and the piercing is performed onto the bulge-formed portion, the bulging-forming and piercing steps can be adapted within the series of processing steps, whereby a preconceived effects can be expected in view of the fabrication costs and operability. That said, these expected effects are limited to the case where the holes have the circle or near-circle configuration in piercing.

DESCLOSURE OF THE INVENTION

As afore-mentioned, in fabricating the automobile parts etc., various piercing operations are required and the configuration of holes to be pierced is not limited to the circle or near-circle. For instance, the holes for adjusting the position and/or height where the parts are fixed are generally configured to be slots so as to give the adjusting function in combination with the one as the fastening jig.

Now, when the prior arts are used to perform a piercing operation to make the slot, the deflection occurs along the periphery of the slot in association with the penetration of the punch through the wall, the configuration of the slot thus made likely becomes distorted, and/or not the whole length of the expected periphery is sheared uniformly, thus likely causing the uncut portion of the periphery to partially be left behind.

Because of this, the excessive distortion of slots thus pierced should take place and/or the partial uncut of the expected periphery of the slots should happen, so that the parts thus made cannot be used for the automobile parts anymore, thereby resulting in decrease of the yield. The occurrence of this kind of work defective is naturally affected by the aspect ratio of the slot, as shown in FIG. 6 described later.

FIG. 1 is a diagram showing the example of the slot configuration to be pierced onto the automobile parts etc. The configuration shown in each of FIGS. 1(*a*) through (*c*) is introduced as an example to be made onto the automobile parts etc. and is not intended to limit the slots pertinent to the present invention. As one of the proper index representing the configuration characteristics of this kind of slots, there is an aspect ratio expressed by b/a where a is the minimum width (minor axis side) and b is the maximum width (major axis side).

Whether the piercing can be performed easily or not in the hydroforming process depends on the aspect ratio. For instance, in case that the aspect ratio becomes three (3) or more, it becomes difficult for the afore-mentioned "a first and second prior arts" to be applied for making the holes properly. In the following, how the work defective should occur in case the first and second prior arts are applied for piercing the slots is recited based on the diagram delineating the cross-section deformation behavior in the hydroforming process.

FIG. 2 is a diagram explaining the deformation behavior in case that "a first prior art" is applied for piercing the slot with the aspect ratio of 3 or more. The diagrams designated "View from X-X" shown on the left side of FIG. 2 are the front cross-sectional views seen from the direction of an arrow X-X in the foregoing FIG. 1(*d*), and similarly, the diagrams designated "View from Y-Y" shown on the right side of FIG. 2 are the front cross-sectional views seen from the direction of an arrow Y-Y in the foregoing FIG. 1(*d*).

FIG. 2(*a*) designates the stage after bulge-forming in the hydroforming process, whereas (*b*) thereof designates the stage that the punch 3 advances a little after bulge-forming by the hydroforming, and whereas (*c*) thereof is the enlarged view of the shear deformation part in the foregoing (*b*) stage, and whereas (*d*) thereof designates the stage that the punch 3 penetrates through the wall of the metal tube blank 1 from the outside to the inside.

As shown in FIG. 2(*a*), the mold 2 provides the die port 4 so as for the punch 3 to move slidably, the metal tube blank 1 is held inside the mold 2 and the working fluid inside the metal tube blank 1 is controlled at the internal pressure Pi.

As shown in FIG. 2(*b*), as the punch 3 advances a little, the shearing is carried out at the top face of the punch 3. For all this, as shown in FIG. 2(*c*), as the punch 3 advances, the shearing proceeds while creating the new shear plane at the portion designated by the symbol "A" in the diagram on the side of "View from X-X", whilst a large deflection takes place along the line expected to be the periphery of the slot at the portion designated by the symbol "B" in the diagram on the side of "View from Y-Y", thus ending up in interrupting the shearing.

Thereafter, as shown in FIG. 2(*d*), in association with the penetration of the punch 3 through the wall, the shearing completes at the portion "A", and then, the shearing at the portion "B" should proceed in turn. But, a large deflection is already generated at the portion "B" and remains as-is after piercing the slot. Thus, a markedly distorted slot happens to be made to thereby be rejected in using as the hydroformed parts.

FIG. 3 is a diagram explaining the deformation behavior in case that "a second prior art" is applied to pierce the slot with the aspect ratio of 3 or more. Similarly to FIG. 2, the diagrams designated "View from X-X" shown on the left side are the front cross-sectional views seen from the direction of an arrow X-X in the foregoing FIG. 1(*d*), and similarly, the diagrams designated "View from Y-Y" shown on the right side are the front cross-sectional views seen from the direction of an arrow Y-Y in the foregoing FIG. 1(*d*).

FIG. 3(*a*) designates the stage after bulge-forming by the hydroforming, whereas (*b*) thereof designates the stage that the bulge-formed portion is formed at the bottom of the die port 4 where the punch 3 retreats after bulge-forming by the hydroforming, and whereas (*c*) thereof is the enlarged view of the shear deformation part in the foregoing (*b*) stage, and whereas (*d*) thereof designates the stage that while the bulge-formed portion at the bottom of the die port 4 is subjected to the internal pressure Pi, the piercing is carried out.

As shown in FIG. 3(*b*), the bulge-formed portion is formed at the bottom of the die port 4 when the punch 3 retreats after bulge-forming by the hydroforming. At the earlier stage that this bulge-formed portion is formed, no discernible deformation takes place at the portion "A" (cross-section of the minor axis side of the slot) in the diagram on the side of "View from X-X", while the bulging largely takes place at the portion "B" (cross-section of the major axis side of the slot) in the diagram on the side of "View from Y-Y".

FIG. 3(*c*) shows a sheared plane C of the deformed portion, whereas no sheared plane is generated at the cross-section of the minor axis side in the diagram "View from X-X", while a large shear plane is generated at the cross-section of the major axis side in the diagram "View from Y-Y". Further, the shear plane generated at the cross-section of the major axis side of the slot becomes maximum at the mid-length of the major axis side and becomes smaller at the position that becomes nearer to the endmost thereof.

Accordingly, as shown in FIG. 3(*d*), the shearing firstly completes at some position of the cross-section of the major axis side (portion "B" in "View from Y-Y") of the slot, while the shearing delays both in another major axis side and in the minor axis side. Therefore, the completion of the shearing on the major axis side of the slot will not mean that the whole length of the expected periphery of the slot is sheared, thus ending up in leaving behind the partial uncut portion.

The incidence of leaving behind the uncut portion of the slot likely increases as the aspect ratio representative of the configuration characteristics of the slot becomes large. Especially, in case the slot with the aspect ratio of 3 or more is pierced, the incidence of leaving behind the partial uncut portion frequently takes place, thus resulting in the marked decrease of the yield of the hydroformed parts.

As afore-described, in case the slot with the aspect ratio of 3 or more is pierced, "a first prior art" will leave a large amount of deflection in association with the penetration of the punch through the wall to thereby yield the slot with marked distortion. And, "a second prior art" is not able to evenly shear the whole length of the expected periphery of the slot to thereby leaving behind the partial uncut portion.

Therefore, in case the automobile parts etc. having slots with the aspect ratio of 3 or more are processed, after processing the workpiece to be bulge-formed (a bulge-forming step) by the hydroforming, an ordinary machining step becomes necessary in order to pierce the holes thereto (a piercing step). In this regard, the hydroforming cannot be adapted within a series of processing steps, so that the cumbersome machining process such as milling needs to be applied, thus leading up to the factors in the rise of manufacturing costs and the hindrance to the efficient production as well.

The present invention is attempted in view of the problems as above, and the object thereof is to provide hydroformed parts, a hydroforming method, and a mold for use in the hydroforming method in which in piercing a slot with the aspect ratio of 3 or more by the hydroforming, even the hydroforming process comprising a bulge-forming step and a piercing step can be applied within a series of processing steps and can ensure an excellent slot configuration.

The present inventor made various investigations in order to solve the foregoing problems, and noted that in "a second prior art" as above, the increase of the stiffness in the length-wise direction of the metal tube blank can eliminate leaving behind the partial uncut portion among the whole length of the periphery of the slot.

In concrete, a concave segment in the length-wise direction is disposed on the top face of the piecing punch, and in the hydroforming process, the metal tube blank is bulge-formed in the manner of following the contour of the concave segment to build a protruded part (rib) thereon, whereby the stiffness in the length-wise direction of the metal tube blank in the area corresponding to the bottom opening of the die port can be increased.

Accordingly, it is found that: In piercing operation subsequent to the retreat of the piercing punch after the hydroforming, that the bulge-forming in the mid-length portion of the major axis side of the slot precedes the bulge-forming in other portions—shown in the foregoing FIGS. 3(*b*) to 3(*d*)—can be prevented; And while not only the entire major axis side of the slot but also the whole portion of the slot periphery can be bulge-formed almost evenly, the shearing can be proceeded, so that the generation of the partial uncut portion can be prevented and the slot with an excellent configuration can be pierced.

The present invention is accomplished based on the foregoing findings, and the gist pertains to the hydroformed parts described in (1) and (2), the hydroforming method described in (3), and the mold for use in the hydroforming method described in (4) as below respectively.

(1) A hydroformed part in which a slot with the aspect ratio of 3 or more is pierced without causing any deflection onto the outer surface of said part and without leaving behind the partial uncut portion by means of an applied pressure onto the working fluid supplied into the inside thereof.

(2) A hydroformed part in which by means of an applied pressure onto the working fluid supplied into the inside thereof, the bulge-forming is carried out and then a slot with the aspect ratio of 3 or more is pierced without causing any deflection onto the outer surface of said part and without leaving behind the partial uncut portion.

(3) A hydroforming method in which while a metal tube blank is held in a pair of molds having a die port for enabling a piercing punch to move slidably and a pressure is simultaneously applied onto the working fluid supplied into the inside thereof, a slot with the aspect ratio of 3 or more is pierced, said die port being configured to have the opening with the aspect ratio of 3 or more, said the piercing punch being configured to have a concave segment in the length-wise direction on the top face thereof, comprising the steps of: said piercing punch slides and moves to the position so that the top face thereof becomes flush with the cavity surface of the molds; the bulge-forming is carried out in the manner of following the contour of the cavity of said molds and the contour of the top face of said piercing punch by applying the internal pressure into the inside of said metal tube blank to thereby increase the stiffness of said metal tube blank in the area corresponding to said die port; and said piercing punch is retreated, resulting in piercing said slot.

(4) A mold for use in the hydroforming method as described in the above (3) in which a slot with the aspect ratio of 3 or more is pierced onto the metal tube blank, comprising: a die port is disposed so as to enable a piercing punch to move slidably; an opening at the bottom of said die port has the aspect ratio of 3 or more; and a concave segment is disposed in the length-wise direction on the top face of said piercing punch, being intended for increasing the stiffness of said metal tube blank in the area corresponding to said die port.

It is preferable that in the hydroforming method and in the mold for use in the hydroforming method according to the present invention, the concave depth Hg of the concave segment disposed on the top face of said piercing punch satisfies the relationship expressed by the equation [1] as below, where t=thickness of the metal tube blank at the bulge-formed portion:

$$0.1t<Hg<3t. \quad [1]$$

Likewise, it is preferable that the concave width Wg of the concave segment disposed on the top face of said piercing punch satisfies the relationship expressed by the equation [2] as below, where Wp=punch width:

$$0.4<Wg/Wp<0.95. \quad [2]$$

According to the hydroforming method by the present invention, even in the case that the slot with the aspect ratio of 3 or more be pierced onto the bulge-formed portion obtained by the hydroforming process, the piercing operation can be carried out within a series of processing steps in the hydroforming process, thereby eliminating the piercing operation by means of the cumbersome machining process such as milling and ensuring an excellent slot configuration.

Therefore, the hydroformed parts according to the present invention are best suited for the automobile parts where various piercing operations are required, and the mold for use in the hydroforming method according to the present invention can be widely employed for processing the automobile parts.

BEST MODE FOR CARRYING OUT THE INVENTION

The present invention relates to a hydroformed part in which the metal tube blank is bulge-formed by the hydroforming and further the slot with the aspect ratio of 3 or more is pierced, a hydroforming method and a mold for use in the hydroforming method, wherein a concave segment is disposed in the length-wise direction on the top face of the piercing punch (hereinafter, referred to as "punch" simply).

Figure 4:
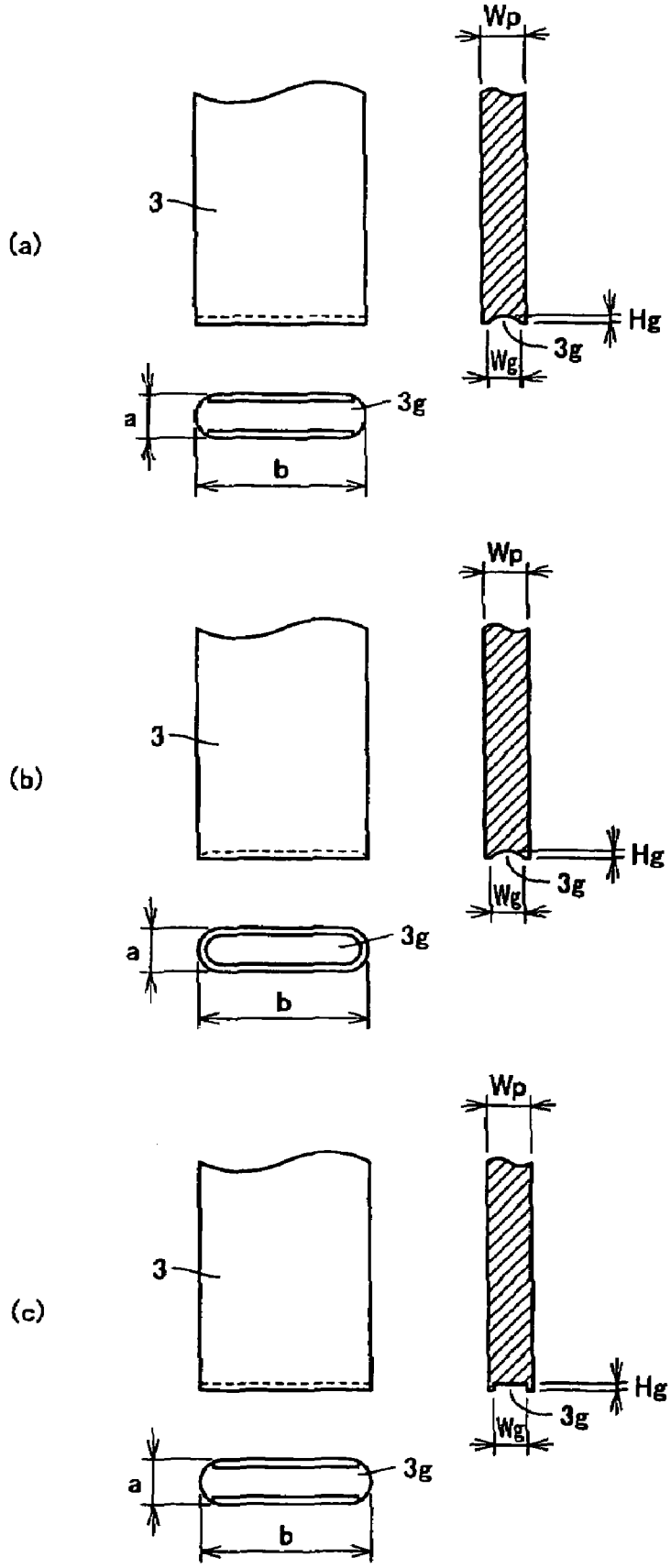

FIG. 4 is a diagram explaining the configuration of the top face of the punch to be used in the present invention in which three kinds of examples designated by (*a*) to (*c*) as to the configuration are shown. The punch 3 shown in FIG. 4(*a*) comprises the concave segment 3g, which is featured by the punch width Wp, the concave width Wg and the concave depth Hg, over the full length in the length-wise direction on its top face. Thus, in the piercing, the periphery of the slot can be evenly sheared.

The punch 3 shown in FIG. 4(*b*) is configured to have the concave segment 3g except both end portions in the length-wise direction, which enables to prevent the surface flaws and/or cracks from occurring on the metal tube blank due to the contact of the metal tube blank with the bottom edge of the die port at the time the metal tube blank stretches and skate over the inside surface of the mold.

The punch 3 shown in FIG. 4(*c*), similarly to the punch 3 shown in FIG. 4(*a*), comprises the configuration having the concave segment 3g over the full length in the length-wise direction on its top face, which is exemplified as the other configuration of the concave segment.

The blade portion of the punch 3 is not particularly specified in terms of the material grade and its configuration, but is preferably configured in light of the durability of the punch 3 so as not to build the sharp edge to have a smooth and continuous transition from the concave segment 3g.

Figure 1:
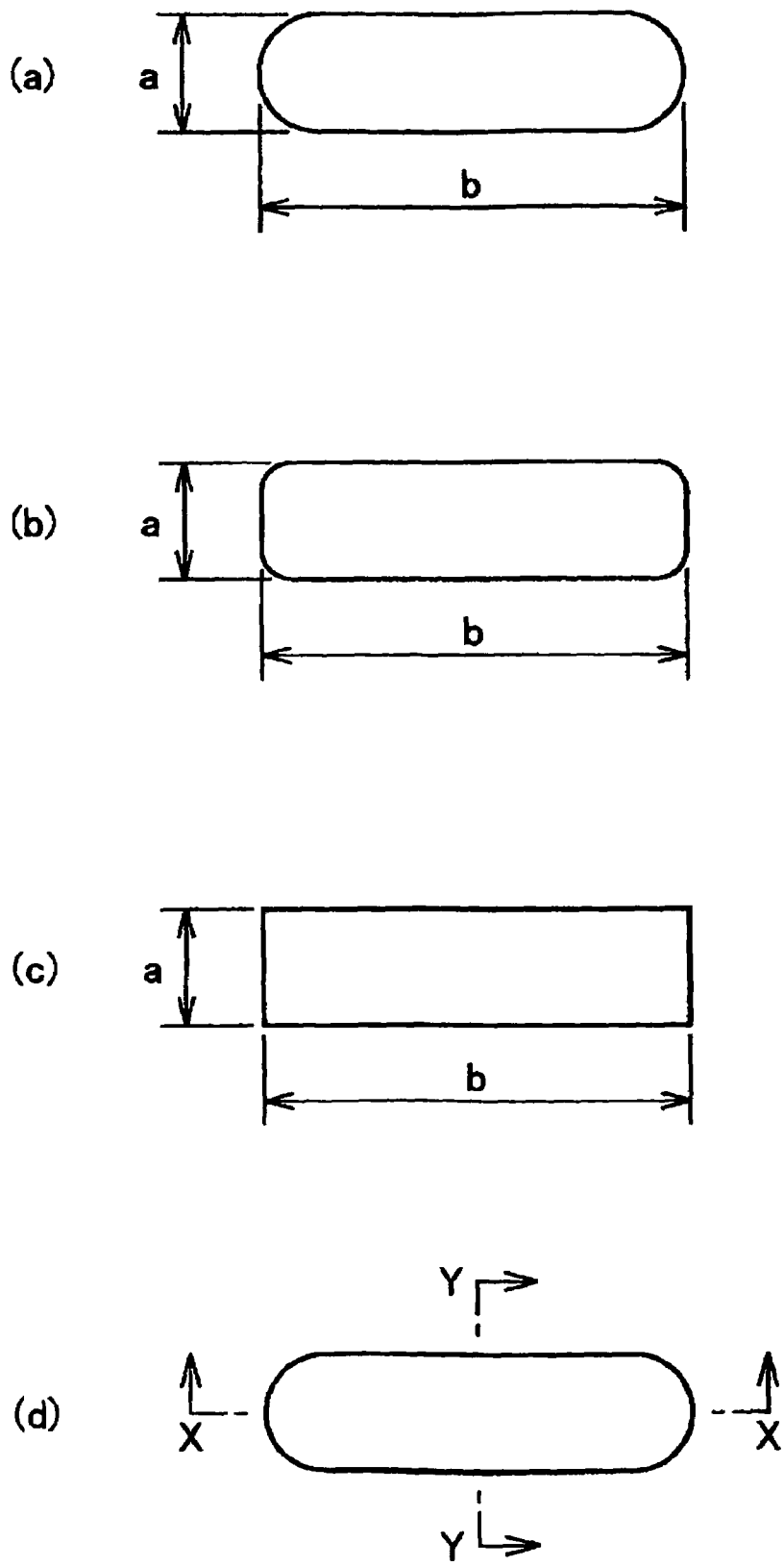
FIGS. 1(*a-d*) are diagrams showing the example of the slot configuration to be pierced onto the automobile parts etc., FIGS. 2(*a-d*) are diagrams explaining the deformation behavior in case that "a first prior art" is applied for piercing the slot with the aspect ratio of 3 or more, FIGS. 3(*a-d*) are diagrams explaining the deformation behavior in case that "a second prior art" is applied to pierce the slot with the aspect ratio of 3 or more, FIGS. 4(*ad*) are diagrams explaining the configuration of the top face of the punch to be used in the present invention in which three kinds of examples as to the configuration are shown in (*a*) to (*c*), FIGS. 5(*a-d*) are diagrams explaining the deformation behavior when a slot with the aspect ratio of 3 or more is pierced using the punch 3 shown in the foregoing FIG. 4(*a*) according to the present invention.
Figure 2:
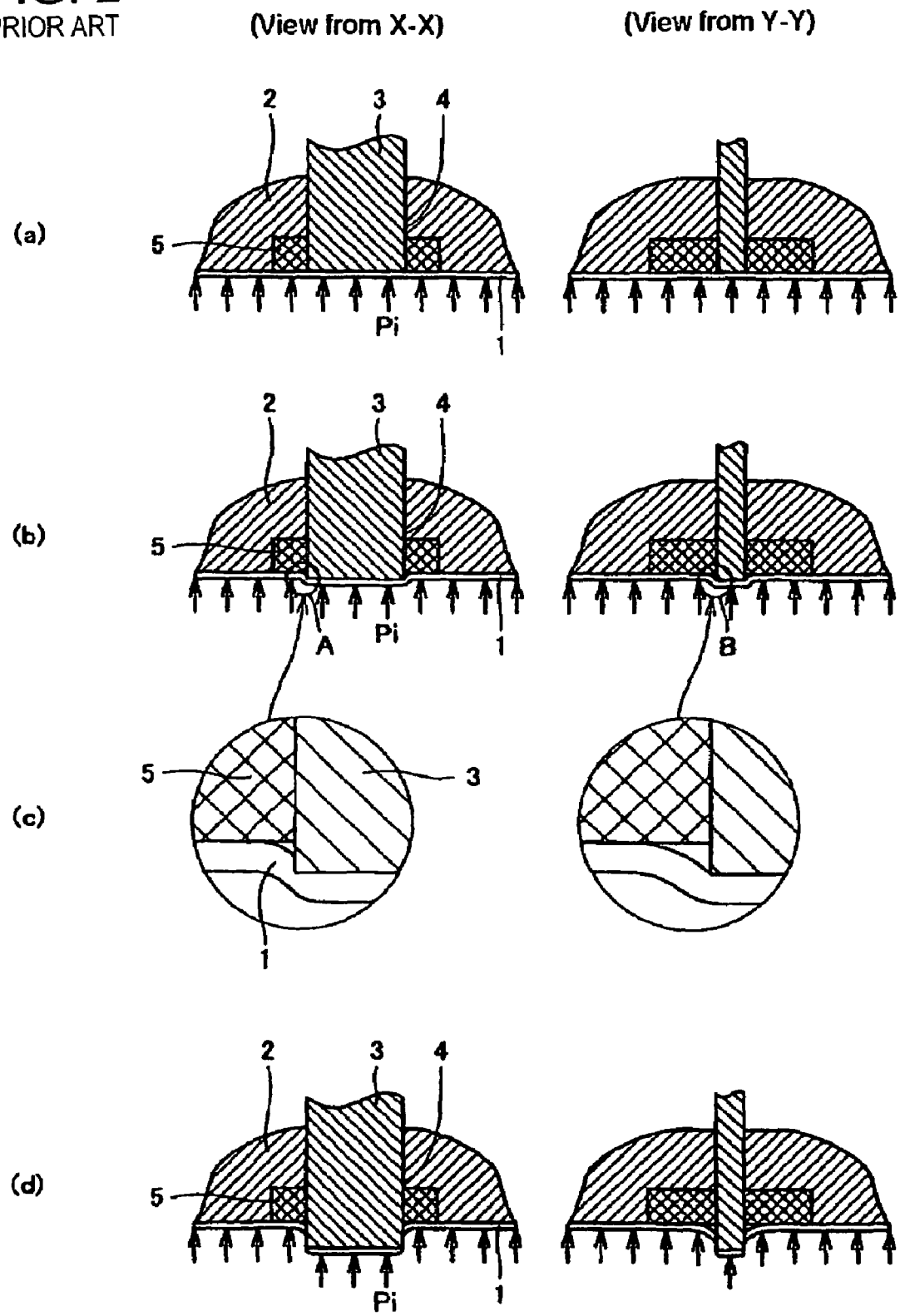
FIG. 2 PRIOR ART
Figure 5:
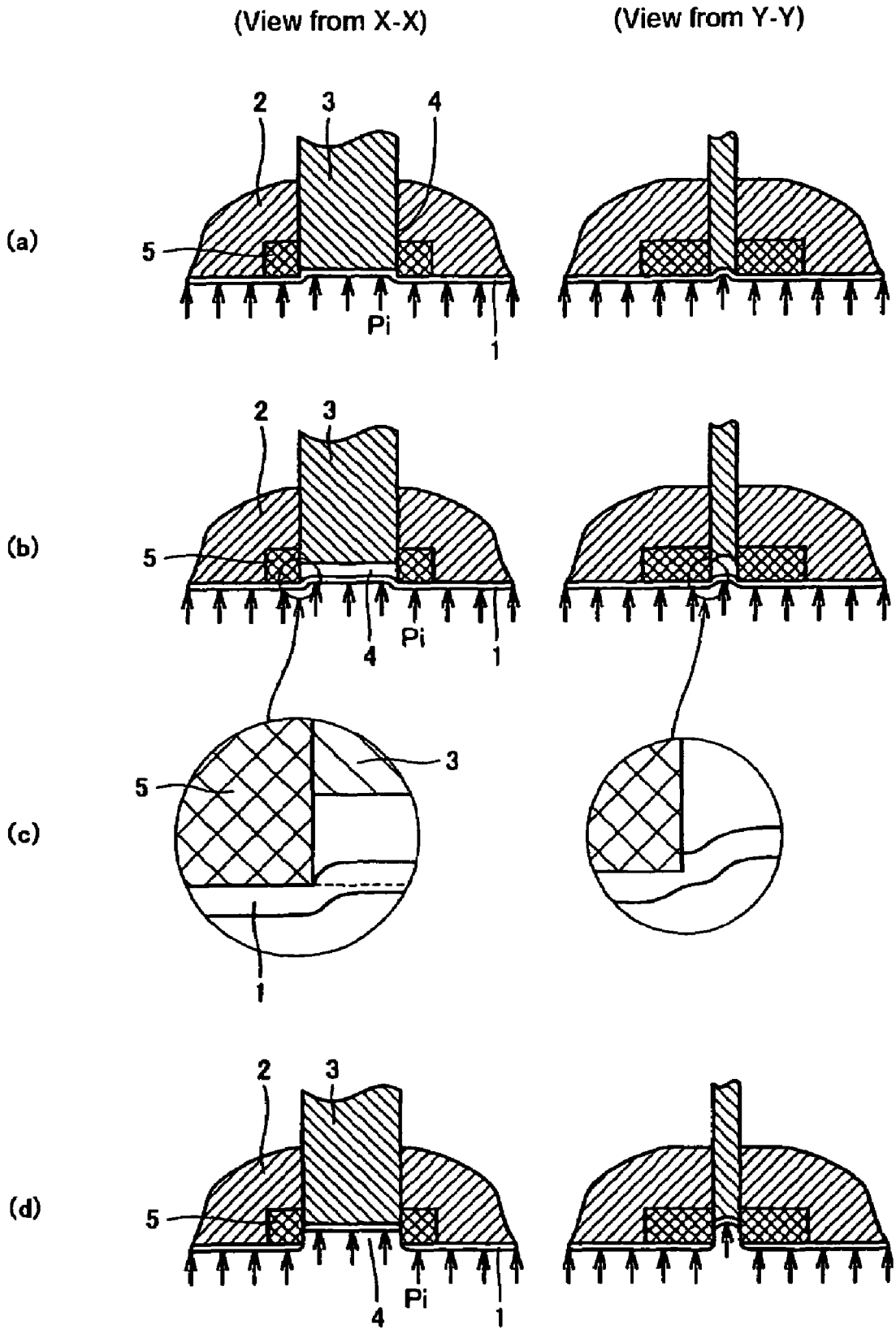

FIG. 5 is a diagram explaining the deformation behavior when a slot with the aspect ratio of 3 or more is pierced using the punch 3 shown in the foregoing FIG. 4(*a*) according to the present invention. The diagrams designated "View from X-X" on the left side of FIG. 5 are the front cross-sectional view seen from the direction of an arrow X-X in the foregoing FIG. 1(*d*), and similarly, the diagrams designated "View from Y-Y" on the right side of FIG. 5 are the front cross-sectional views seen from the direction of an arrow Y-Y in the foregoing FIG. 1(*d*).

FIG. 5(*a*) designates the stage after bulge-forming in the hydroforming process, whereas (*b*) thereof designates the stage that the punch 3 retreats subsequent to bulge-forming by the hydroforming and the shearing proceeds while the bulge-formed portion is formed at the region corresponding to the bottom opening of the die port 4, and whereas (*c*) thereof is the enlarged view of the shear deformation part in the foregoing (*b*) stage, and whereas (*d*) thereof designates the stage, that while the bulge-formed portion at the bottom opening of the die port 4 is subjected to the internal pressure Pi, the piercing is carried out.

As shown in FIG. 5(*a*), the metal tube blank 1 is bulge-formed by the hydroforming, where the internal pressure Pi is applied, in the manner of following the contour of the cavity surface of the mold 2 and the contour of the concave segment disposed on the top face of the punch 3 simultaneously. By bulging the metal tube blank in the manner of following the contour of the concave segment as above, the stiffness in the length-wise direction for only the portion of the metal tube blank 1 corresponding to the bottom opening of the die port 4 can be enhanced.

Incidentally, the punch 3 is supported at the rear end by the cylinder not shown in the diagram and kept to stay at the predetermined position during the hydroforming so as not to move slidably. The force F to support the punch 3 by the cylinder has to satisfy the equation [3] as below so as not to allow the sliding movement thereof in association with the hydroforming:

$$F > A \cdot P\max \quad [3]$$

where A: cross-section area of die port

Pmax: maximum internal pressure during the hydroforming.

And then, as shown in FIG. 5(*b*), while the internal pressure Pi is applied onto the metal tube blank 1 being bulge-formed, the punch 3 retreats and the slot is to be pierced by the shearing owing to the internal pressure Pi that is applied to the bulge-formed portion of the metal tube blank being formed at the bottom opening of the die port 4.

At this occasion, the protruded part is built in the length-wise direction on the bulge-formed portion of the metal tube blank 1 in the manner of following the contour of the concave segment disposed on the top face of the punch 3, so that the stiffness of the whole bulge-formed portion becomes high. Consequently, as shown in FIG. 5(*c*), the portion of the metal tube blank 1 corresponding to the bottom opening of the die port 4 comes to bulge evenly all over the bottom opening of the die port 4, so that the shear plane develops almost evenly along the whole expected periphery of the slot to thereby allow the shearing uniformly.

And in the end, as shown in FIG. 5(*d*), although the fracture penetrates through the wall at the very portion where the shearing proceeds faster than the other periphery portion of the slot, the shearing in other portions progresses more or less at the similar pace, whereby the leftover of the partial uncut portion does not occur and the whole periphery of the slot is sheared to complete the piercing.

In order to perform the piercing operation by applying the internal pressure onto the metal tube blank, the internal pressure Pi at the piercing subsequent to the hydroforming is required to satisfy the equation [4] as below:

$$Pi > S \cdot t \cdot k / A \quad [4]$$

where S periphery length of the bottom opening of the die port

A: cross-section area of the die port t: wall thickness of the metal tube blank where to be processed k: shear resistance.

In the constitution shown in FIG. 5, a die 5 is contained within the mold 2, but it is not essential to dispose the die 5. This is for the reason that as the mold 2 itself is made of hard substance, the die port 4 can be directly provided in the mold 2 itself to fulfill the function of the die 5 without newly disposing the die 5.

Therefore, while the die port specified in the present invention is provided in order to pierce the slot and its dimension is limited, it can be provided either directly in the mold 2 or in the die 5 set within the mold 2.

In the case that the die 5 is not provided, the whole mold 2 needs to be replaced upon the damage of the die port due to the wear. Therefore, it is preferable that the simply replaceable die 5 is provided in the mold 2.

Further, in the constitution shown in FIG. 5, a set of die port 4 and punch 3 capable of the slidable movement is shown, whereas the configuration and/or the number of each of them is determined by the specification of the formed parts in concern.

As afore-described, the present invention is characterized in that the concave segment is disposed on the top face of the punch to be used, whereas the configuration of the concave segment entails preferable limitation, which will be recited as below.

Figure 6:
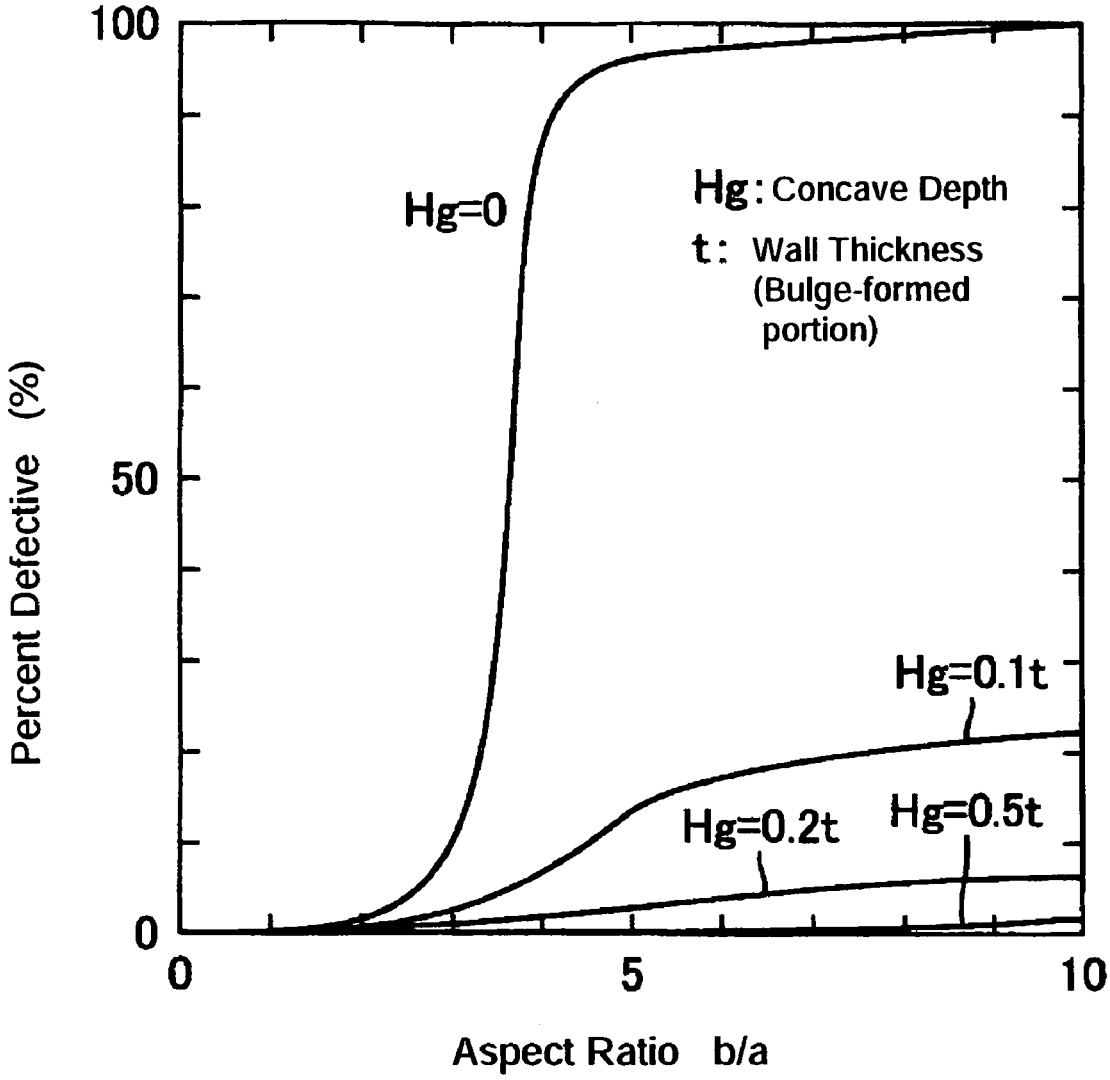
FIG. 6 is a diagram showing the relationship between the aspect ratio and the percent defective when the piercing operation is carried out subsequent to the hydroforming.

FIG. 6 is a diagram showing the relationship between the aspect ratio and the percent defective when the piercing operation is carried out subsequent to the hydroforming. Here, the defined as "defective" is pertinent to the case that part of the sheared waste remains as an uncut portion after the piercing, resulting in hanging over the partial uncut portion.

In FIG. 6, the concave depth Hg of the concave segment disposed on the top face of the punch is used as a parameter in relation to the wall thickness t at the bulge-formed portion of the metal tube blank, whereas in the case that the conventional punch is employed (Hg=0), the aspect ratio exceeding three (3) causes the percent defective to aggravate markedly, and further the aspect ratio exceeding five (5) makes it almost impossible to pierce the excellent slot.

In the case that the punch specified in the present invention is employed, the percent defective is improved significantly according to the concave depth Hg: for instance, when the concave depth Hg is 0.1t, even the aspect ratio of 9 or less can reduce the percent defective down to about 20%: when the concave depth Hg is 0.2t, the percent defective decrease down to 10% or less irrespective of the aspect ratio: and further, when the concave depth Hg is 0.5t, the percent defective becomes nearly 0% (zero).

When the concave depth Hg of the concave segment is too small, the bulged height of the metal tube blank being formed in the manner of following the contour of the concave segment becomes low to thereby reduce the effect on heightening the stiffness of the portion corresponding to the major axis side of the bottom opening (slot configuration) of the die port. In this regard, it is preferable that the concave depth Hg of the concave segment is set to 0.1t or more. On the other hand, when the concave depth Hg becomes excessive, the cracks may occur during bulging the metal tube blank in the manner of following the contour of the concave segment, so that the concave depth Hg of the concave segment is preferably set to 3.0t or less.

Namely, it is preferable that the concave depth Hg of the concave segment satisfies the equation [1a] as below in terms of the wall thickness t of the processed region of the metal tube blank:

$$0.1t<Hg<3t. \quad [1a]$$

Irrespective of the aspect ratio, the percent defective can be reduced down to 10% or less, when the concave depth Hg of the concave segment preferably satisfies the equation [1b] as below in terms of the wall thickness t of the processed region of the metal tube blank:

$$0.2\ t<Hg<3t. \quad [1b]$$

It is more preferable that as the occurrence of the defective can be almost completely prevented, the depth Hg of the concave segment satisfies the equation [1c] as below in terms of the wall thickness t of the processed region of the metal tube blank:

$$0.5t<Hg<3t. \quad [1c]$$

Next, as regards the concave width of the concave segment, the larger concave width Wg with respect to the punch width Wp further facilitates the metal tube blank to bulge-form in the manner of following the contour of the concave segment, which is preferable. Moreover, when the concave width Wg of the concave segment becomes large, the protruded part formed by the bulge-forming can be extended to the nearer portion to be sheared to thereby reinforce the relevant portion, whereby the progress of the partial shearing can be suppressed.

Figure 7:
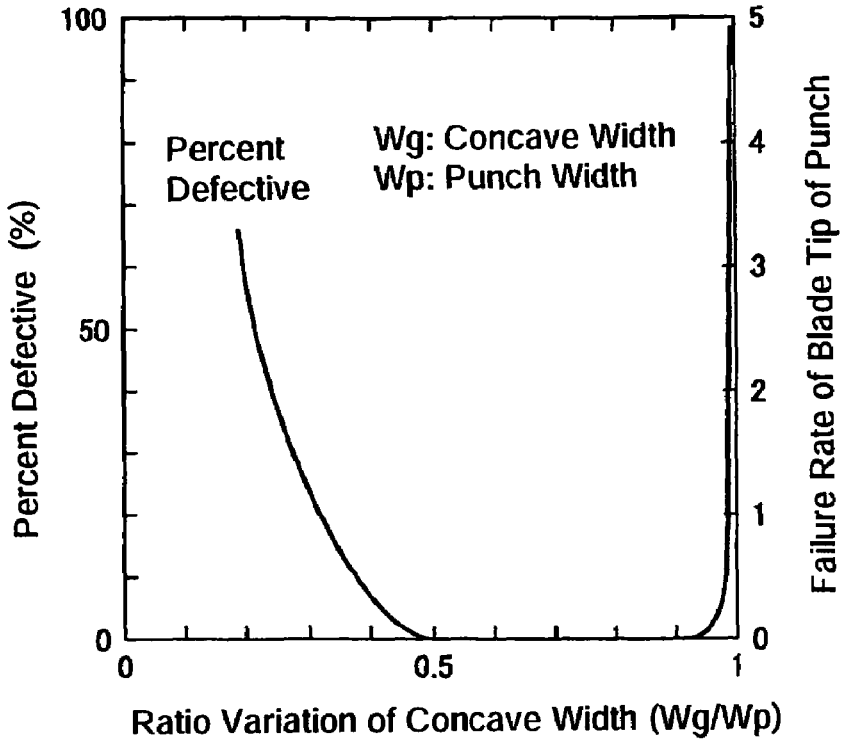
FIG. 7 is a diagram showing the relationship between the percent defective and the failure rate of the blade tip of the punch with variance of the concave width ratio (Wg/Wp) when the piercing operation is carried out subsequent to the hydroforming.

FIG. 7 is a diagram showing the relationship between the percent defective and the failure rate of the blade tip of the punch with variance of the concave width ratio (Wg/Wp) when the piercing operation is carried out subsequent to the hydroforming. Similarly to the case in the foregoing FIG. 6, the defined as "defective" is pertinent to the case that a portion of the scrap in shearing remains as an uncut portion after the piercing, resulting in hanging down the partial uncut portion. Besides, the "failure rate of the blade tip of the punch" is valuated such that the extent of the failure of the blade tip of the punch subsequent to 10000 runs is classified into five (5) categories, wherein zero (0) means no failure and the category of the larger number indicates more failure incidence.

It is qualitatively perceived that the larger concave width Wg of the concave segment with respect to the punch width Wp enhances the stiffness more to thereby reinforce the portion to be sheared. Quantitatively speaking, from the result shown in FIG. 7, it is preferable that Wg/Wp is set to 0.4 or more.

Meanwhile, when the concave width Wg of the concave segment becomes excessive, the blade tip of the punch gets thinner to lose the strength to likely get damaged, whereas when Wg/Wp exceeds 0.95, the failure incidence of the punch significantly increases.

Namely, it is preferable that the concave width Wg of the concave segment satisfies the conditions expressed by the equation [2] as below in terms of the punch width Wp:

$$0.4<Wg/Wp<0.95. \quad [2]$$

EXAMPLES

In the following, the effects by the hydroforming method according to the present invention are recited based on the concrete examples.

Inventive Example

The metal tube blanks with the dimension of Outside diameter: 60.5 mm, Wall thickness: 2 mm, and Length: 800 mm, as per Mechanical and Structural Steel Tubes designated by STKM11A (JIS G3445), are prepared as testing materials. The yield strength of the metal tube blanks is 330 MPa, and the tensile strength thereof is 440 MPa.

Figure 8:
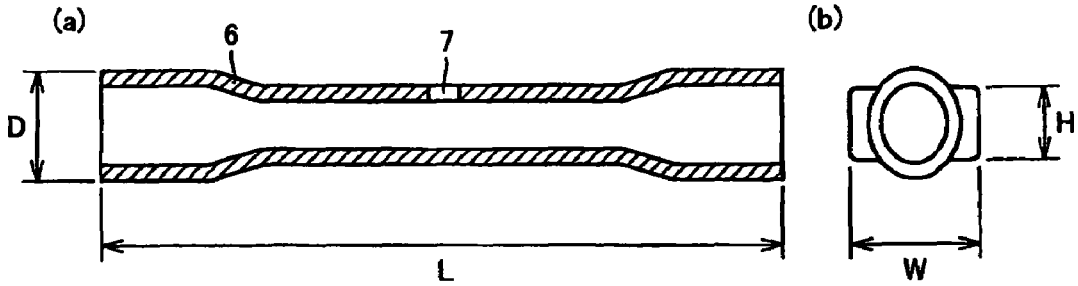
FIG. 8 is a diagram showing the shape of the hydroformed parts, whereas (*a*) is a front view, and whereas (*b*) is a side view.

FIG. 8 is a diagram showing the representative shape of the hydroformed parts, whereas FIG. 8(*a*) is a front view, and whereas FIG. 8(*b*) is a side view.

Each of the foregoing metal tube blanks is subjected to the hydroforming process with the constitution shown in the foregoing FIG. 5 to be bulge-formed into the parts 6 with the shape shown in FIG. 8, followed by piercing the slot 7. The nominal dimension of the parts 6 is represented by Height H: 46 mm, Width W: 75 mm, Length L: 760 mm, and End Portion Outside Diameter D: 60.5 mm.

The punch used in the hydroforming process is exactly as per the foregoing FIG. 4A, the nominal dimension of which is represented by Maximum Width a: 30 mm, Minimum Width b: 8 mm, Concave Width Wg: 6 mm, and Concave Depth Hg: 2 mm.

After forming into the shape of the part 6 shown in the foregoing FIG. 8, while the internal pressure is kept at 190 MPa, the punch retreats, thus piercing the slot 7 represented by Major Axis Side: 30 mm and Minor Axis Side: 8 mm (Aspect Ratio: 3.75).

The number of the piercing run is 10000 off in which in each run, no partial scrap in shearing remained along the periphery, and the slots with excellent configuration are pierced.

Comparative Example

Figure 3:
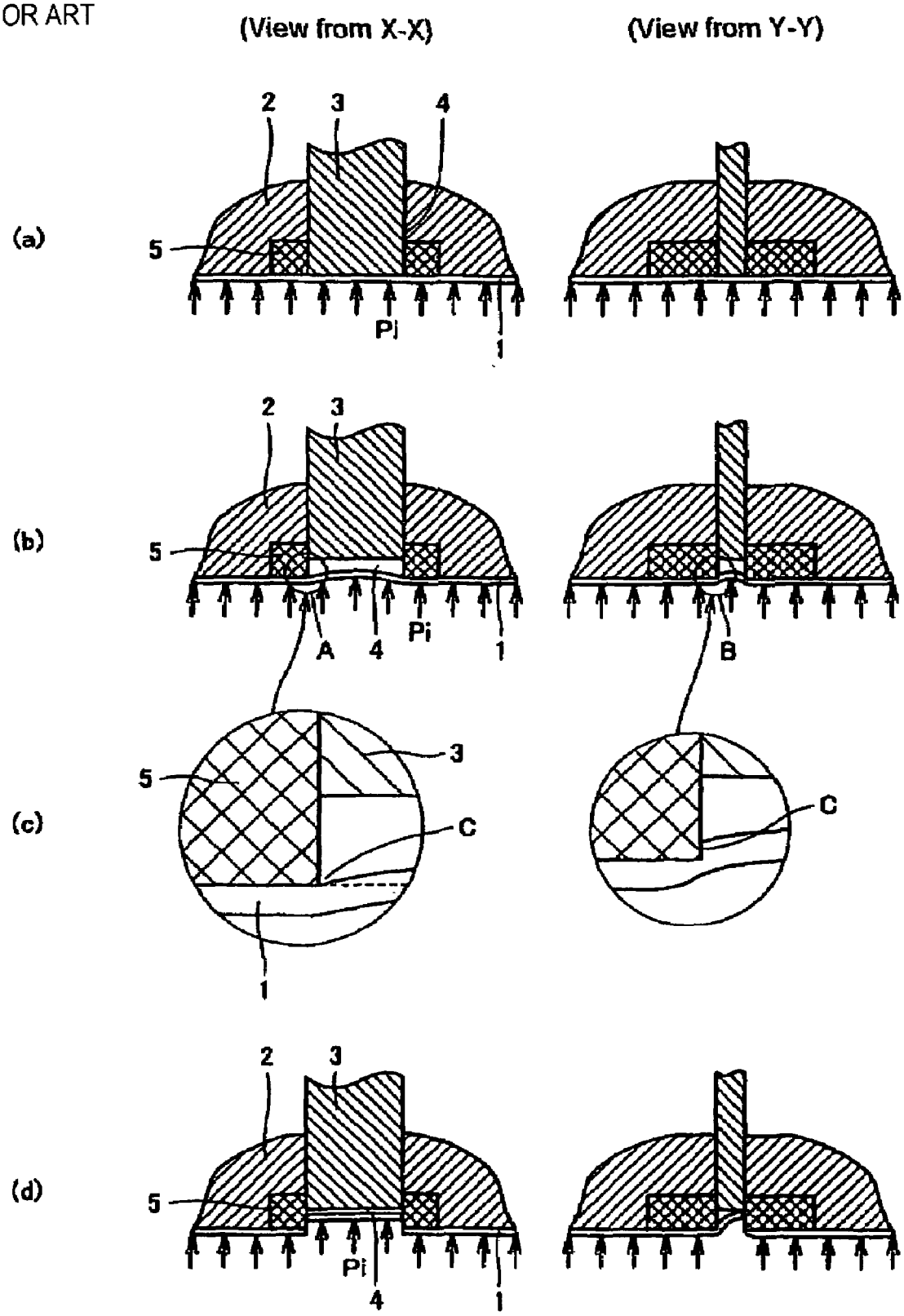
FIG. 3 PRIOR ART

The metal tube blanks identical to the case of Inventive Example are prepared and each of them is subjected to the hydroforming process with the constitution shown in the foregoing FIG. 3 to be bulge-formed into the part 6 with the shape shown in FIG. 8, followed by piercing the slot 7. Incidentally, the dimension of the punch used in the hydroforming process is represented by Maximum Width a: 30 mm and Minimum Width b: 8 mm, while setting Concave Depth Hg: 0 mm, in which the concave segment is not provided thereto.

After forming into the shape of the part 6 shown in the foregoing FIG. 8, while the internal pressure is kept at 190 MPa, the punch retreats, thus piercing the slot 7 with the dimension identical to the case of Inventive Example. The number of the piercing run is 10000 off. The test result reveals that the satisfactory piercing of slots accounts for only 1%, and all the rest cause the defective such that the shear scrap is partially left behind and hangs over.

INDUSTRIAL APPLICABILITY

According to the hydroforming method by the present invention, in the case that the slot with the aspect ratio of 3 or more be pierced onto the bulge-formed portion obtained by the hydroforming, even the piercing operation can be carried out within a series of processing steps in the hydroforming process, thereby eliminating the piercing operation by means of the cumbersome machining process such as milling and ensuring an excellent slot configuration. Thus, the hydroformed parts according to the present invention are best suited for the automobile parts and the like where various piercing operations are required, and the mold for use in the hydroforming method according to the present invention can be widely employed for processing the automobile parts and the like, whereby the present invention can be applied for processing the parts not only in an automotive industry but also in an industrial machinery.

What is claimed is:

1. A hydroforming method for forming a slot with an aspect ratio of 3 or more in a metal tube blank comprising the steps of:

holding a metal tube blank in a pair of molds, with at least one die port formed in one of the molds, the die port enabling a piercing punch to move slidably therein and being configured with an opening with the aspect ratio of 3 or more, the piercing punch being configured to have a concave segment in a length-wise direction on the top face thereof, sliding and moving said piercing punch to a position so that the top face thereof becomes flush with a cavity surface of the pair of molds;

bulge-forming in a manner of following a contour of the cavity of said pair of molds and that of the top face of said piercing punch by applying a pressure to a working fluid supplied to an inside of said metal tube blank; and retreating said piercing punch to pierce the metal tube blank and form said slot.

2. The hydroforming method according to claim 1, wherein a concave depth Hg of the concave segment disposed on the top face of said piercing punch satisfies a relationship expressed by the equation [1] as below, where t=thickness of the metal tube blank at the bulge-formed portion:

$$0.1t<Hg<3t \quad [1].$$

3. The hydroforming method according to claim 1, wherein a concave width Wg of the concave segment disposed on the top face of said piercing punch satisfies the relationship expressed by the equation [2] as below, where Wp=punch width:

$$0.4<Wg/Wp<0.95 \quad [2].$$

4. A mold used for a hydroforming method in which a slot with an aspect ratio of 3 or more is pierced onto a metal tube blank, the metal tube blank held by a pair of molds, and pressure is applied onto a working fluid inside the metal tube blank for hydroforming and piercing, with a piercing punch contacting an outer surface of the metal tube blank during application of the pressure during hydroforming and retreating from a surface of the hydroformed metal tube for piercing, the mold comprising:

a die port for enabling a piercing punch to move slidably;

an opening with the aspect ratio of 3 or more at a bottom of said die port; and a concave segment disposed in a length-wise direction on a top face of said piercing punch;

wherein a concave depth Hg of the concave segment disposed on the top face of said piercing punch satisfies the relationship expressed by the equation [1] as below, where t=thickness of the metal tube blank at the bulge-formed portion:

$$0.1t<Hg3t \quad [1].$$

5. A mold used for a hydroforming method in which a slot with an aspect ratio of 3 or more is pierced onto a metal tube blank, the metal tube blank held by a pair of molds, and pressure is applied onto a working fluid inside the metal tube blank for hydroforming and piercing, with a piercing punch contacting an outer surface of the metal tube blank during application of the pressure during hydroforming and retreating from a surface of the hydroformed metal tube for piercing, the mold comprising:

a die port for enabling a piercing punch to move slidably;

an opening with the aspect ratio of 3 or more at a bottom of said die port; and a concave segment disposed in a length-wise direction on a top face of said piercing punch;

wherein a concave width Wg of the concave segment disposed on the top face of said piercing punch satisfies the relationship expressed by the equation [2] as below, where Wp=punch width:

$$0.4<Wg/Wp<0.95 \quad [2].$$

* * * * *